US006851362B2

(12) United States Patent
Brown et al.

(10) Patent No.: US 6,851,362 B2
(45) Date of Patent: Feb. 8, 2005

(54) PRINTING CYLINDER WITH FANOUT COMPENSATION

(75) Inventors: Kenneth Waldo Brown, Barrington, NH (US); Charles Henry Dufour, Durham, NH (US); Charles Reif Hammond, Durham, NH (US); John Sheridan Richards, Barrington, NH (US); John James Sposato, Jr., Somersworth, NH (US)

(73) Assignee: Goss International Americas, Inc., Dover, NH (US)

( * ) Notice: Subject to any disclaimer, the term of this patent is extended or adjusted under 35 U.S.C. 154(b) by 66 days.

(21) Appl. No.: 10/104,390

(22) Filed: Mar. 22, 2002

(65) Prior Publication Data

US 2003/0177924 A1 Sep. 25, 2003

(51) Int. Cl.[7] ..... B41F 13/24

(52) U.S. Cl. ..... 101/248; 101/220; 101/486; 101/216; 101/485

(58) Field of Search ..... 101/415.1, 382.1, 101/383, 481, 368, 115, 116, 474, 248, 220, 485–486, 216, 375–378

(56) References Cited

U.S. PATENT DOCUMENTS 4,089,265 A * 5/1978 White et al. ..... 101/375
4,207,815 A * 6/1980 Watanabe ..... 101/248
4,391,898 A * 7/1983 van der Velden ..... 430/306
4,812,219 A * 3/1989 Sattrup et al. ..... 101/375
5,284,090 A * 2/1994 Okamura et al. ..... 101/248
5,365,847 A * 11/1994 Pers ..... 101/248
5,383,393 A 1/1995 Ueda et al. ..... 101/220
6,021,713 A * 2/2000 Glockner et al. ..... 101/211
6,484,632 B2 * 11/2002 Hoffmann et al. ..... 101/217
6,513,431 B2 * 2/2003 Huber ..... 101/375
6,553,908 B1 * 4/2003 Richards et al. ..... 101/248

OTHER PUBLICATIONS

U.S. Appl. No. 09/675,494, filed Sep. 29, 2000.

U.S. Appl. No. 09/627,639, filed Jul. 28, 2000.

U.S. Appl. No. 09/948,232, filed Sep. 7, 2001.

* cited by examiner

*Primary Examiner*—Andrew H. Hirshfeld
*Assistant Examiner*—Marissa Ferguson
(74) *Attorney, Agent, or Firm*—Davidson, Davidson & Kappel, LLC

(57) ABSTRACT

A printing cylinder for a web printing press includes an extensible cylindrical sleeve configured for carrying an image to be printed. An extension device is provided for applying a force to the sleeve so as to stretch at least a portion of the sleeve and axially move the image. A method of web fanout compensation is provided.

20 Claims, 3 Drawing Sheets

PRINTING CYLINDER WITH FANOUT COMPENSATION

BACKGROUND

The present invention relates generally to printing presses and other imaging devices and more particularly to an image-carrying cylinder.

In a web offset lithographic printing press, a printing plate for an image to be printed is inked, and the image is then transferred to a blanket, which transfers the image to a continuous web of material. The printing press typically has four printing units, each for printing one of four colors on the web. As the web passes by the blanket cylinders of the printing units, it becomes moist, which can lead to an expansion of the web. The expansion of the web in the axial direction of the printing cylinders is known as web fanout. If fanout occurs, the print or images on the web thus expand slightly as the web passes each printing unit. The second and further printing units need to be properly registered with respect to the web images or print in an axial direction of the cylinders, so that, for example, a second color is applied by the second print unit directly over an image already printed by the first printing unit.

U.S. Pat. No. 4,207,815 purports to disclose a two-plate plate cylinder. One plate fits on a large diameter portion and another plate fits on a tube rotatable and axially movable with respect to the large diameter portion. The tube is fastened to a stepped shaft. Helical gearing is provided to set the axial and circumferential register of the plates. In such a device fretting and corrosion problems may occur between the tube and the stepped shaft. Also, it may be difficult to print multiple web widths on a triple wide press using such a device since the location of the boundary between the large diameter portion and the tube depends on the web width.

U.S. Pat. No. 5,383,393 purports to disclose a multicolor lithographic rotary press comprising a plurality of printing sections arranged along a traveling line of a paper web, a plurality of register adjusting means, a paper stretching means, and a plurality of width adjusting means. Each of the printing sections further includes at least one divided plate cylinder, each divided section of which is independently moved in the axial direction and/or circumferential direction. The device of the '393 patent further discloses a register adjusting means mechanically connected to each of the divided plate cylinders in the printing sections, and includes an adjusting mechanism for actuating the divided sections in response to the control unit connected to a sensor for detecting the lines and images printed on the paper web by each of the printing sections. Problems with such a device are that the paper stretching and/or paper adjusting means, such as bustle rollers, have a limited control range and may smear the print.

Commonly-owned U.S. Ser. No. 09/627,639 entitled "Multi-Plate Plate Cylinder for a Printing Press", which is hereby incorporated by reference herein, discloses a multi-plate plate cylinder having independently registerable shells. Commonly-owned U.S. Ser. No. 09/675,494 entitled "Web Fanout Control System", which is hereby incorporated by reference herein, discloses a web fanout control system for a printing press having multiple images carrying by the plate cylinder. Commonly-owned U.S. Ser. No. 09/948,232 entitled "Printing Press with Multiple-Image-Carrying Cylinder", which is hereby incorporated by reference herein, discloses a multiple-image-carrying cylinder having an axially movable ring located between a shell and a cylinder section, the ring capable of having another part of a first image when connected to the cylinder section and capable of having another part of a second image when connected to the shell. These commonly-owned applications are not necessarily prior art to the present invention.

SUMMARY OF THE INVENTION

The present invention provides a printing cylinder for a web printing press. The printing cylinder includes an extensible cylindrical sleeve configured for carrying a image to be printed. An extension device is provided for applying a force to the sleeve so as to stretch at least a portion of the sleeve and axially move the image. The first image may be disposed on a printing plate, the printing plate being attached to the sleeve.

The extension device may apply a second force to the sleeve so as to stretch at least a second portion of the sleeve. The extension device may apply the forces so as to stretch the portions of the sleeve in opposite directions. Moreover, the extension device may include a threaded rod and a nut connected to the sleeve and engaging the rod. A rotation of the rod causes an axial movement of the nut in a direction so as to stretch a portion of the sleeve or allow a portion of the sleeve to contract.

The extension device may further include a second nut connected to the sleeve at a second location on the sleeve and engaging a second threaded rod, the second rod being configured so that the rotation of the second rod causes an axial movement of the second nut in a second direction opposite the first direction so as to stretch a second portion of the sleeve or allow the second portion of the sleeve to contract. The threaded rods may be coupled so as to rotate in concert with each other.

A plate cylinder may be provided wherein the sleeve circumscribes the plate cylinder and is attached to the plate cylinder so that a third of the sleeve is not extensible. The image may be disposed on at least a portion of the remaining two thirds of the sleeve. A second image may be disposed on the third of the sleeve. Moreover, the attachment position may be aligned with a split between two formers of a former section of the printing press.

In other embodiments, the sleeve may instead be attached at a central portion of the sleeve to the plate cylinder at a second location on the plate cylinder, the nuts being attached to the sleeve on opposite sides of the central portion of the sleeve. The attachment position may be aligned with a center of a middle former of a former section of the printing press. Moreover, the sleeve may carry a second image to be printed, the images being disposed on opposite sides of the attachment position of the sleeve so that the images move in axially opposite directions when the extension device applies the force.

The sleeve may include a mesh structure. Moreover, the sleeve may include an elastic material.

A control unit may be provided for determining a width of a web traveling through the printing press and controlling the extension device in response to thereto.

The present invention also provides a web printing press including an extensible cylindrical sleeve for carrying an image to be printed. An extension device is provided for applying a force to the sleeve so as to stretch at least a portion of the sleeve and axially move the image.

Additionally, the present invention provides a method for compensating for web fanout. The method includes providing an extensible cylindrical sleeve for carrying an image to be printed. A force is applied to the cylindrical sleeve so as to stretch at least a portion of the sleeve and axially move the image The present invention provides fanout compensation over a wide range of web widths without problems, such as fretting and corrosion problems, of prior devices.

BRIEF DESCRIPTION OF THE DRAWINGS

The present invention is elaborated upon below based on exemplary embodiments with reference to the accompanying drawings.

DETAILED DESCRIPTION

Figure 1:
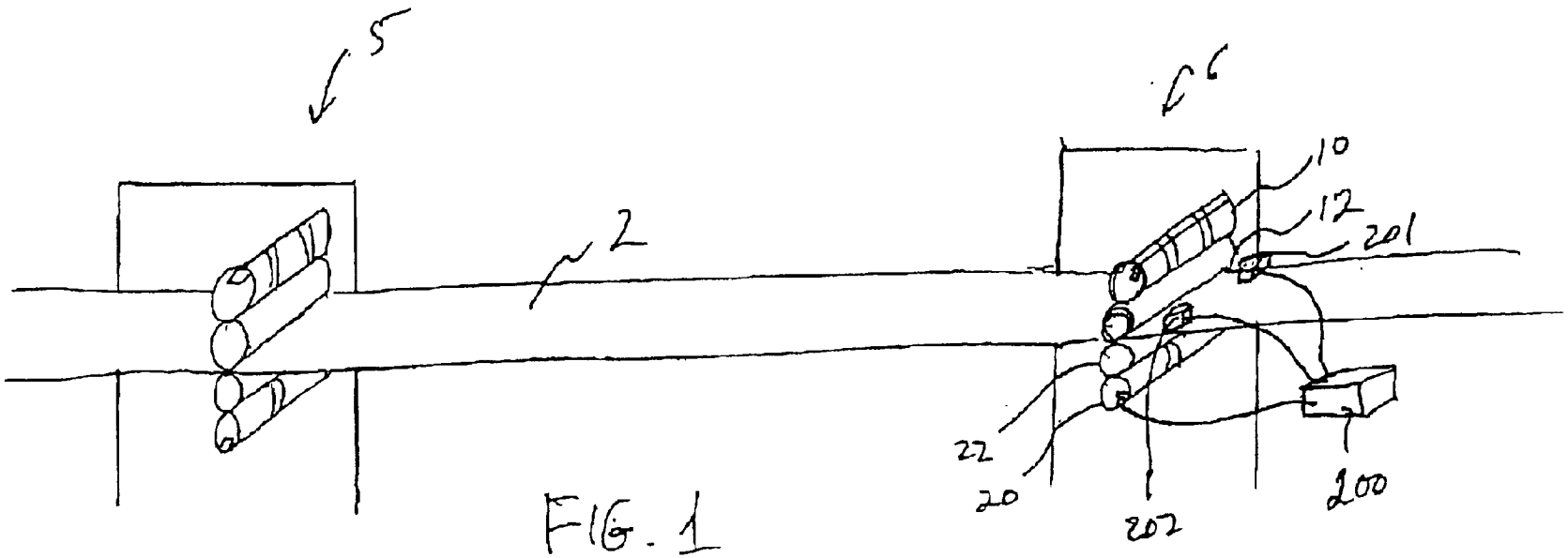
FIG. 1 shows schematically and in partial detail a preferred offset lithographic web printing press according to the present invention.

FIG. 1 shows an exemplary offset lithographic web printing press with a first printing unit 5 and a second printing unit 6, although typically four such units are provided for a four-color press. Printing unit 6 has a first printing cylinder 10, a first blanket cylinder 12, a second printing cylinder 20 and a second blanket cylinder 22.

A web 2 is printed with side-by-side images, for example six wide, in a first color in first printing unit 5. Second printing unit 6 then prints a second color over the first images. Due to fanout of web 2, the images printed by the second printing unit 6 may be laterally adjusted to compensate for the fanout.

A control unit 200, for example one including a microprocessor, can read inputs from sensors 201, 202 for determining a width of web 2. The sensors 201, 202 can be located after or before the blanket cylinders 12, 22. Control unit 200 can then set the proper web width, as will described below.

Figure 2:
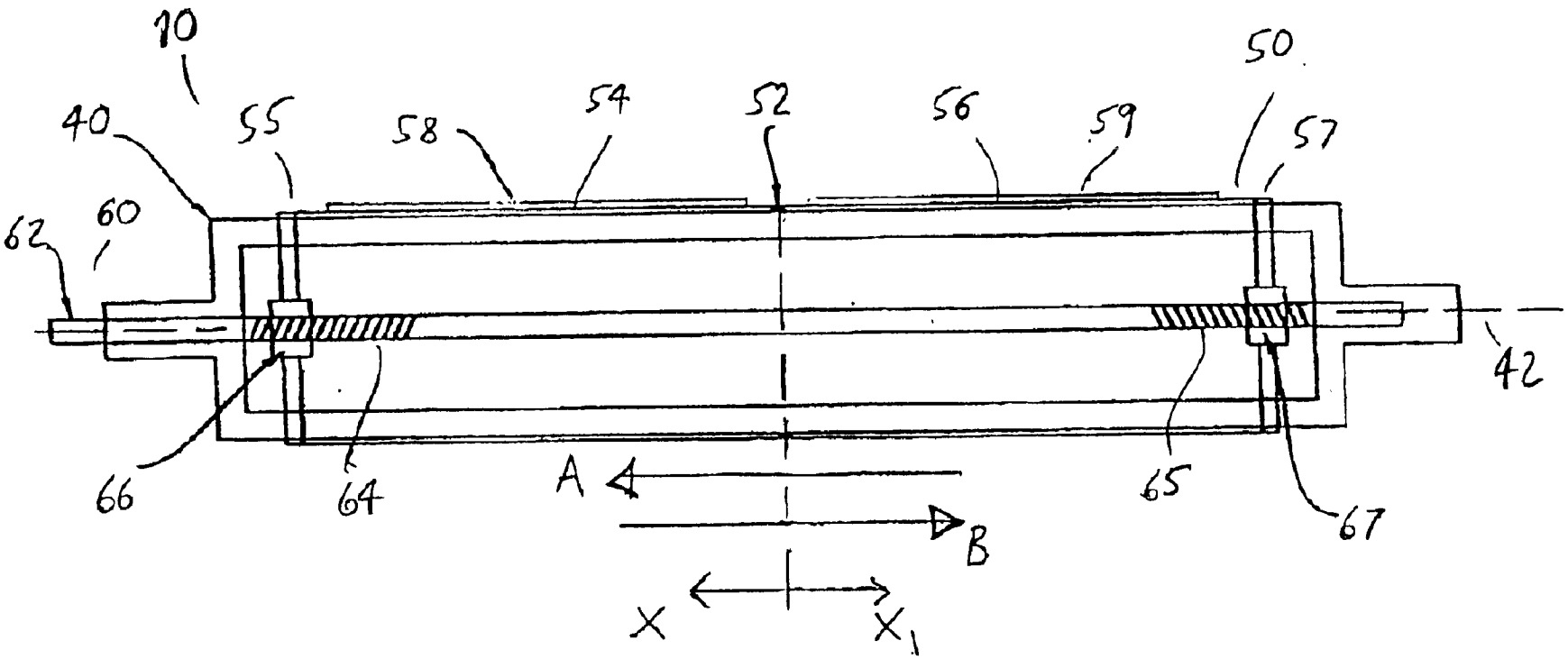
FIG. 2 shows a schematic cross-section of a printing cylinder according to the present invention with the sleeve attached at a central portion of the sleeve.

FIG. 2 shows a schematic cross-section of printing cylinder 10, which rotates about axis 42. Printing cylinder 10 includes plate cylinder 40 and cylindrical extensible sleeve 50. Extensible sleeve 50 is fixedly attached to plate cylinder 10 at a central portion of the sleeve at point 52, with sections 54 and 56 of the sleeve either side of point 52 being able to move axially relative to the plate cylinder. Extensible sleeve 50 is generally tube-shaped and disposed so that plate cylinder 40 is nested inside the extensible sleeve. Printing plates 58 and 59 each carry at least one image and are fixedly attached to extensible sleeve 50. In other embodiments of the present invention, more than one printing plate may be attached to extensible sleeve 50 either side of point 52. Since printing plates 58 and 59 are attached to extensible sleeve 50, and the extensible sleeve is attached to plate cylinder 10, printing plates 58 and 59 rotate about axis 42 as the plate cylinder does.

Extension device 60 is provided for stretching extensible sleeve 50. Extension device 60 includes rod 62 having threaded portions 64 and 65. Threaded portions 64 and 65, which are oppositely threaded, engage nut members 66 and 67, respectively. Nut members 66 and 67 are attached to ends 55 and 57 of extensible sleeve 50. Rod 62 is rotatable so as to cause nut members 66 and 67 to translate in opposite respective axial directions A and B, due to the opposite threading of threaded portions 64 and 65. When nut members 66 and 67 translate in opposite axial directions A and B, respectively, they apply opposite forces to extensible sleeve 50.

Extensible sleeve 50 is stretched symmetrically about point 52, causing printing plates 58 and 59 to move in opposite axial directions A and B, respectively and thereby compensate for fanout of web 2. Similarly, when rod 62 is rotated so that nut members 66 and 67 translate in opposite axial directions B and A, respectively, extensible sleeve 50 is allowed to contract symmetrically about point 52. Printing plates 58 and 59 are thereby moved in opposite axial directions B and A, respectively. Attachment point 52 may be aligned with the center of the middle former of a downstream former section of the printing press, for example by laterally adjusting plate cylinder 40. Control unit 200 (FIG. 1) may be used to control extension device 60 so as to provide a desired fanout compensation.

The amount of stretch in extensible sleeve 50 may be proportional to the distance X, $X_1$ in direction A, B, respectively, away from point 52, so that portions of the sleeve that are axially further away from point 52 stretch more than portions of the sleeve that are axially closer to point 52. The fanout, or expansion, of web 2 axially away from point 52 may be similarly proportional to the distance X, $X_1$. In embodiments of the present invention in which more than one printing plate is disposed on either side of point 52, the stretching behavior of extensible sleeve 50 may thus advantageously axially displace printing plates further away from point 52 more than printing plates closer to point 52, providing improved fanout compensation.

In certain embodiments of the present invention, rod 62 may be replaced by a respective rod (not shown) for each nut member 66, 67 so that the respective force applied to each end 55, 57 of extensible sleeve 50 may be controlled independently. Such embodiments permit fanout compensation where the web fanout is not symmetrical about the web centerline.

The centers of printing plates 58 and 59 may be put into register by moving plate cylinder 40, by relocating the printing plates on the cylinder and/or by stretching extensible sleeve 50 as described herein, thereby reducing fanout error at the outer edges of the plates.

Extensible sleeve 50 may be made of any suitable elastic material, such as a composite material, or rubber, for example. Extensible sleeve 50 may have a mesh structure which permits the sleeve to stretch when under a force and contract when the force is removed or reduced.

Extensible sleeve 50 may be attached to plate cylinder by any suitable attachment method. For example, pins, screws, clips or welds, or any combination thereof, may be used, as would apparent to those of skill in the art.

In certain embodiments of the present invention, extensible sleeve 50 form the plate cylinder itself.

A circumferential register mechanism (not shown) for extensible sleeve 50 may be provided.

Printing plates 58 and 59 may be attached to extensible sleeve 50 by any suitable method, such as, for example, a lock-up mechanism of a kind known to those of skill in the art. Such a lock-up mechanism may have a hydraulically-actuated piston holding the printing plate in a slot in extensible sleeve 50. Alternatively, one or more pins or clips may be used to hold the printing plate in place in a slot in the sleeve. In other embodiments of the present invention, where extensible sleeve 50 has a mesh structure, tabs projecting from the printing plate and inserted into the mesh may be used to attach the printing plate to the sleeve. In some embodiments of the present invention, printing plates 58 and 59 may be axially slidable in slots in plate cylinder 40. In still other embodiments of the present invention, a magnetic attachment method may be employed for attaching the printing plates 58 and 59 to extensible sleeve 50.

Figure 3:
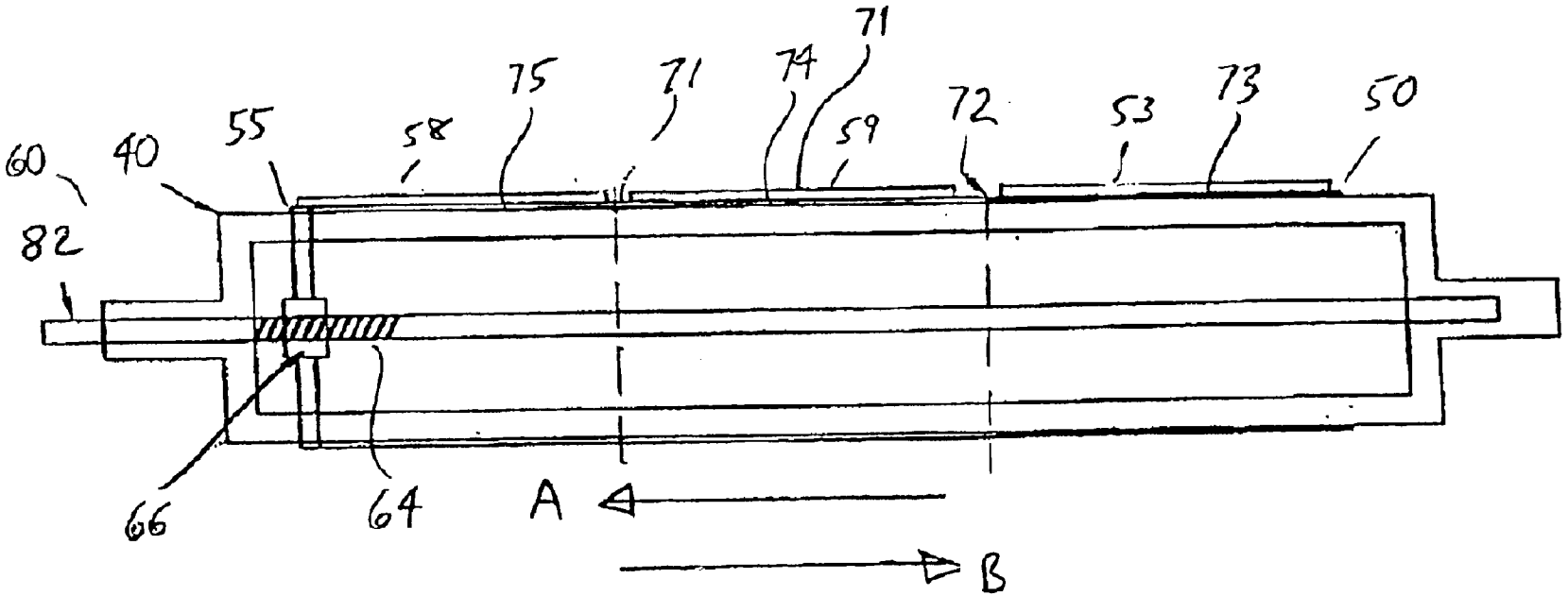
FIG. 3 shows a schematic cross-section of a printing cylinder according to the present invention with the sleeve attached to the plate cylinder so that a third of the sleeve is fixed relative to the plate cylinder.

FIG. 3 shows a schematic cross-section of a printing cylinder according to an embodiment of the present invention with sleeve 50 attached to plate cylinder 40 so that a third of the sleeve is fixed relative to the plate cylinder. Such an embodiment may be used for a triple-wide press, for example. Here, extensible sleeve 50 is attached to plate cylinder 40 at point 72, dividing the sleeve into sections 71 and 73. Section 71 is about twice as large as section 73, i.e., the axial length of section 73 is about a third of the total axial length of extensible sleeve 50. Printing plates 58 and 59 are disposed on section 71, while printing plate 53 is disposed on section 73.

With further reference to FIG. 3, in the embodiment shown, extension device 60 includes rod 82 having single threaded portion 64. Threaded portion 64 engages single nut member 66. Nut member 66 is attached to end 55 of extensible sleeve 50. Rod 82 is rotatable so as to cause nut member 66 to axially translate due to the interaction with threaded portion 64. When nut member 66 translates in axial direction A, it applies a force to extensible sleeve 50, causing section 71 to stretch. Because extensible sleeve 50 is fixedly attached to plate cylinder 40 at point 72, section 73 of the sleeve does not stretch with section 71. When rod 82 is rotated so as to cause nut member 66 to translate in axial direction B, the force on extensible sleeve 50 is reduced, allowing the sleeve to contract.

The center of printing plate 53 on section 73 may be put into register by laterally adjusting plate cylinder 40. Then rod 82 may be rotated to move section 71, and with it printing plates 58 and 59, to reduce fanout error for these plates.

In another embodiment of the present invention, extensible sleeve 50 may be attached to plate cylinder 40 at attachment point 71 on central third section 74 so that the central third is fixed relative to the plate cylinder and outer third sections 73 and 75 may be stretched relative to the fixed central third section. Section 73 may be provided with a nut member 67, as in FIG. 2 (not shown in FIG. 3) for stretching that section of extensible sleeve 50. In such an embodiment, printing plate 59 may be put into register by laterally moving plate cylinder 40. Then rod 82 may be rotated to move sections 73 and 75, and with them printing plates 53 and 58, to reduce fanout error for these plates. In some embodiments of the present invention, nut members 66 and 67 may be independently movable so that outer third sections 73 and 75 may be independently stretchable, thereby providing independent adjustability of printing plates 53 and 58.

Variations according to the present invention are possible. For example, extension device 60 may be any suitable device for applying a force or forces to stretch extensible sleeve 50. Any desired number or numbers of printing plates may be disposed on extensible sleeve 50 in any desired arrangement. The printing plates may be, for example, single wide, double wide (panorama), or larger multiples of a single wide. Attachment point 52, 71, 72 may be located on any desired position on extensible sleeve 50. Selection of the number and arrangement of printing plates, as well as the location of attachment points may depend on the width of web 2 as well as the configuration of downstream press components, such as formers, etc. Moreover, multiple attachment points may be provided at desired locations on extensible sleeve 50 to achieve any desired combination and arrangement of fixed and movable plates.

It will of course be understood that the present invention has been described above only by way of example and that modifications of details can be made within the scope of the invention.

What is claimed is:

1. A printing cylinder for a web printing press, comprising:

an axially extensible cylindrical sleeve configured for carrying a first image to be printed; and an extension device configured for applying a first axial force to the sleeve so as to stretch at least a first portion of the sleeve in an axial direction and axially move the first image.

2. The printing cylinder as recited in claim 1 wherein the extension device is further configured for applying a second force to the sleeve so as to stretch at least a second portion of the sleeve.

3. The printing cylinder as recited in claim 2 wherein the extension device is further configured for applying the first and second forces so as to stretch the at least first and second portions of the sleeve in opposite directions.

4. The printing cylinder as recited in claim 1 wherein the extension device includes a first threaded rod and a first nut connected to the sleeve at a first location on the sleeve and engaging the first rod, the first rod being configured so that a rotation of the rod causes an axial movement of the nut in a first direction so as to stretch the at least first portion of the sleeve or allow the at least first portion of the sleeve to contract.

5. The printing cylinder as recited in claim 4 further comprising a plate cylinder and wherein the sleeve circumscribes the plate cylinder and is attached to the plate cylinder at a first attachment location on the plate cylinder so that a third of the sleeve is not extensible.

6. The printing cylinder as recited in claim 5 wherein the first image is disposed on at least a portion of a remaining two thirds of the sleeve.

7. The printing cylinder as recited in claim 6 further comprising a second image disposed on the third of the sleeve.

8. The printing cylinder as recited in claim 5 wherein the first attachment location is aligned between two images on the sleeve.

9. The printing cylinder as recited in claim 4 wherein the extension device further includes a second nut connected to the sleeve at a second location on the sleeve and engaging a second threaded rod, the second rod being configured so that the rotation of the second rod causes an axial movement of the second nut in a second direction opposite the first direction so as to stretch at least a second portion of the sleeve or allow at least the second portion of the sleeve to contract.

10. The printing cylinder as recited in claim 9 wherein the first and second threaded rods are coupled so as to rotate in concert with each other.

11. The printing cylinder as recited in claim 9 further comprising a plate cylinder and wherein the sleeve circumscribes the plate cylinder and a central portion of the sleeve is attached to the plate cylinder at a second location on the plate cylinder, the first and second nuts being attached to the sleeve on opposite sides of the central portion of the sleeve.

12. The printing cylinder as recited in claim 11 wherein the second location on the plate cylinder is aligned with a center of the plate cylinder.

13. The printing cylinder as recited in claim 9 wherein the cylindrical sleeve is further configured for carrying a second image to be printed, the first and second images being disposed on the opposite sides of a central portion of the sleeve so that the first and second images move in axially opposite directions when the extension device applies the force.

14. The printing cylinder as recited in claim 1 wherein the sleeve includes a mesh structure.

15. The printing cylinder as recited in claim 1 wherein the sleeve includes an elastic material.

16. The printing cylinder as recited in claim 1 further comprising a control unit configured for determining a width of a web traveling through the printing press and controlling the extension device in response to thereto.

17. The printing cylinder as recited in claim 1 wherein the first image is disposed on a printing plate, the printing plate being attached to the sleeve.

18. A web printing press comprising:

an axially extensible cylindrical sleeve configured for carrying an image to be printed; and an extension device configured for applying a first axial force to the sleeve so as to stretch at least a portion of the sleeve in an axial direction and axially move the image.

19. The web printing press as recited in claim 18 further comprising a plate cylinder, the extensible sleeve being disposed so as to circumscribe the plate cylinder and being attached to the plate cylinder so as to rotate with the plate cylinder.

20. A method for compensating for web fanout, the method comprising:

providing an axially extensible cylindrical sleeve configured for carrying an image to be printed; and applying a first axial force to the cylindrical sleeve so as to stretch at least a portion of the sleeve in an axial direction and axially move the image.

* * * * *